US012746634B2

(12) United States Patent
Fan et al.

(10) Patent No.: US 12,746,634 B2
(45) Date of Patent: Sep. 29, 2026

(54) ROAD-RAIL DUAL PURPOSE QUICK DISASSEMBLY AND ASSEMBLY TYPE RAIL GRINDING MAINTENANCE ROBOT

(71) Applicant: Beijing Jiaotong University, Beijing (CN)

(72) Inventors: Wengang Fan, Beijing (CN); Yi Wang, Beijing (CN); Zhiwei Wu, Beijing (CN); Jiang Li, Beijing (CN); Jianyong Li, Beijing (CN); Yueming Liu, Beijing (CN); Meng Nie, Beijing (CN); Kang Xu, Beijing (CN)

(73) Assignee: BEIJING JIAOTONG UNIVERSITY, Beijing (CN)

( * ) Notice: Subject to any disclaimer, the term of this patent is extended or adjusted under 35 U.S.C. 154(b) by 577 days.

(21) Appl. No.: 18/462,300

(22) Filed: Sep. 6, 2023

(65) Prior Publication Data

US 2024/0218608 A1 Jul. 4, 2024

(30) Foreign Application Priority Data

Jan. 3, 2023 (CN) ..... 202310006944.9

(51) Int. Cl.
*B24B 19/00* (2006.01)
*B24B 23/08* (2006.01)
*E01B 31/17* (2006.01)

(52) U.S. Cl.
CPC ..... *B24B 19/004* (2013.01); *E01B 31/17* (2013.01); *B24B 23/08* (2013.01); *E01B 2203/14* (2013.01)

(58) Field of Classification Search
CPC .... E01B 31/17; E01B 31/12; E01B 2203/141; B24B 41/02; B24B 41/005; B24B 41/04;
(Continued)

(56) References Cited

FOREIGN PATENT DOCUMENTS

CN 110886270 A * 3/2020 ..... E01B 31/17
CN 111661097 A * 9/2020 ..... B61F 7/00
(Continued)

OTHER PUBLICATIONS

Machine translation of CN-110886270-A (Year: 2020).*
Machine translation of CN-111661097-A (Year: 2020).*
Machine translation of CN-113445375-A (Year: 2021).*

*Primary Examiner* — Robert F Neibaur
(74) *Attorney, Agent, or Firm* — Christensen O'Connor Johnson Kindness PLLC

(57) ABSTRACT

Provided is a road-rail dual purpose quick disassembly and assembly type rail grinding maintenance robot, including a left robot grinding unit, a right robot grinding unit and quick unit connecting devices. The two robot grinding units are fixedly connected to the left and right sides of the quick unit connecting devices by the quick unit connecting devices so as to achieve quick assembly and disassembly of the robot. Each of the robot grinding units includes a robot grinding device, a rail walking device, road walking devices, a frame, a shell component and an electric control component. The robot grinding device is fixedly installed on the inner side of the upper part of the frame. The rail walking device and the road walking devices are fixedly installed at the bottom of the frame. The degree of intelligent and flexible of rail grinding operation can be significantly improved.

9 Claims, 6 Drawing Sheets

(58) Field of Classification Search
CPC ... B24B 41/06; B24B 27/0076; B24B 27/033; B24B 19/004; B24B 47/12; B24B 45/006; B24B 23/08; B24B 21/12
USPC ..... 451/347, 429
See application file for complete search history.

(56) References Cited

FOREIGN PATENT DOCUMENTS

| | | | | | |
|---|---|---|---|---|---|
| CN | 113355960 | A | | 9/2021 | |
| CN | 113445375 | A | * | 9/2021 | ..... E01B 31/17 |

* cited by examiner

ROAD-RAIL DUAL PURPOSE QUICK DISASSEMBLY AND ASSEMBLY TYPE RAIL GRINDING MAINTENANCE ROBOT

CROSS-REFERENCE TO RELATED APPLICATION

This patent application claims the benefit and priority of Chinese Patent Application No. 202310006944.9 filed with the China National Intellectual Property Administration on Jan. 3, 2023, the disclosure of which is incorporated by reference herein in its entirety as part of the present application.

TECHNICAL FIELD

The present disclosure relates to the technical field of rail grinding maintenance, in particular to a road-rail dual purpose quick disassembly and assembly type rail grinding maintenance robot.

BACKGROUND

When a train runs on rails, complex and changeable load impact between the wheels of the train and the rails may cause many diseases on the surfaces of the rails, so the rails need to be maintained in time by rail grinding technology to improve the wheel-rail matching relationship, prolong the service life of the rails and ensure the stability and safety of train operation. At present, although the existing automatic rail grinding equipment, such as a self-driven intelligent abrasive belt grinder described in CN113355960A and a rail grinding device described in CN113455375A, can realize automatic grinding of rail diseases, there are still the following shortcomings: Firstly, the grinding equipment can only walk on the rails, it is inconvenient to carry the grinding equipment due to its own weight when working rails or places need to be changed, so that personnel cost and time cost are increased. Secondly, the adjustment of a rail grinding angle is realized by controlling the three degrees of freedom of lateral movement, deflection and lifting. There are some shortcomings such as complex structure, cumbersome adjustment of executive units and slow speed, and the degree of flexibility of the equipment is not high.

SUMMARY

In view of the above problems, the present disclosure provides a road-rail dual purpose quick disassembly and assembly type rail grinding maintenance robot, so that the degree of intelligence and flexibility of rail grinding can be significantly improved. Moreover, the robot can realize quick walking on both roads and rails, thereby the requirements of on-site working conditions are met. In order to achieve the above purposes, the present disclosure provides the following technical solution.

A road-rail dual purpose quick disassembly and assembly type rail grinding maintenance robot includes a left robot grinding unit used for grinding a left rail, a right robot grinding unit used for grinding a right rail, and quick unit connecting devices used for connecting the left robot grinding unit and the right robot grinding unit. Each of the left robot grinding unit and the right robot grinding unit includes a robot grinding device, a rail walking device, road walking devices, a frame, a shell component and an electric control component. The robot grinding device is fixedly installed on the inner side of the upper part of the frame. During working, a front end of the robot grinding device, i.e., a grinding wheel, extends from the inner side of the frame to the position of a rail, and full profile grinding of the rail is achieved by adjusting the position and posture of the robot grinding device. The rail walking device is fixedly installed at the bottom of the frame. The road walking devices are fixedly installed at the bottom of the frame. The shell component is fixedly installed on the frame and used for covering and protecting components inside the frame. The electric control component is fixedly installed on the frame and used for controlling the movement speed of the robot and the position of the robot grinding units.

On the basis of the above solution, the robot grinding device includes a guide rail mechanism and a grinding mechanism. The grinding mechanism is installed below the guide rail mechanism. The grinding mechanism includes a grinding wheel motor, a mechanical arm motor, a secondary mechanical arm, a gear transmission shaft, a primary mechanical arm, a mechanical arm end cover, a main body base, a motor output gear, a gear outer end gasket, a transmission gear, a mechanical arm joint, an upper connecting flange, a flange support plate, a lower connecting flange, a grinding wheel connecting sleeve, a grinding wheel cover and a grinding wheel. The guide rail mechanism is fixedly installed on the inner side of the upper part of the frame.

The main body base is fixedly installed below the guide rail mechanism. The mechanical arm motor is fixedly installed inside the main body base. An inner hole of the motor output gear is matched and connected with an output shaft of the mechanical arm motor through a shaft hole. The primary mechanical arm is installed on connecting plates protruding on both sides of the main body base. The mechanical arm end cover is fixedly installed on an outer end face of a cylindrical part of the primary mechanical arm. One end of the gear transmission shaft is installed in the cylindrical part of the primary mechanical arm, and the other end of the gear transmission shaft is matched and connected with the transmission gear through a shaft hole. The transmission gear is meshed and connected with the motor output gear. One end of the mechanical arm joint is installed on a lower end face of the primary mechanical arm, and the other end of the mechanical arm joint is installed on an upper end face of the secondary mechanical arm. The primary mechanical arm is hinged and matched with the secondary mechanical arm. The upper connecting flange is hinged with the secondary mechanical arm through the mechanical arm joint. An upper end of the flange support plate is fixedly connected with the upper connecting flange, and a lower end of the flange support plate is fixedly connected with the lower connecting flange. The grinding wheel connecting sleeve is fixedly installed below the lower connecting flange. The grinding wheel motor is installed above the grinding wheel connecting sleeve. The grinding wheel is installed below the grinding wheel connecting sleeve, and an inner hole of the grinding wheel is matched and connected with an output shaft of the grinding wheel motor through a shaft hole. The grinding wheel cover is fixedly installed on the periphery of the grinding wheel connecting sleeve.

On the basis of the above solution, the mechanical arm joint includes an upper mounting base, a joint outer end cover, a joint rotating shaft and a lower mounting base. The upper mounting base is fixedly installed on the lower end face of the primary mechanical arm. The lower mounting base is fixedly installed on the upper end face of the secondary mechanical arm. The joint rotating shaft is installed in inner holes of the upper mounting base and the lower mounting base through bearings. The upper mounting base is hinged with the lower mounting base. The joint outer end cover is fixedly installed on the outer end face of the upper mounting base.

On the basis of the above solution, each of the quick unit connecting devices includes a connecting device base, a base, a rotating flange bearing, an electromagnet, unit connecting tightening nuts, an electromagnet tightening bolt, a rotatable flange, an end face gasket and unit connecting tightening bolts. The connecting device base is fixedly installed on the frame. The base is fixedly connected with the connecting device base through bolts, and the rotating flange bearing is installed on an outer ring of a protruding part of the base. The rotatable flange is installed on an outer ring of the rotating flange bearing. The electromagnet is fixedly installed on an inner ring of the protruding part of the base through the electromagnet tightening bolt. The end face gasket is fixedly installed at position of an end face of the rotatable flange. The unit connecting tightening nuts and the unit connecting tightening bolts are used for fixedly connecting the two rotatable flanges.

On the basis of the above solution, the rail walking device includes a rail front wheel and a rail rear wheel. The rail front wheel is fixedly installed at the front of the bottom of the frame. The rail rear wheel is fixedly installed at the rear of the bottom of the frame.

On the basis of the above solution, the rail walking device also includes a rail front wheel dust board and a rail rear wheel dust board. The rail front wheel dust board is fixedly installed on the inner side of the rail front wheel. The rail rear wheel dust board is fixedly installed on the inner side of the rail rear wheel.

On the basis of the above solution, each of the road walking devices includes a caster, a caster connecting piece, a caster motor, a motor mounting plate, a caster rotating shaft, a caster fixing base and a caster support plate. The motor mounting plate is fixedly connected with the frame. The caster fixing base is fixedly connected with the frame. An inner hole at an upper end of the caster connecting piece is connected with the caster fixing base through the caster rotating shaft. The caster motor is fixedly connected with the motor mounting plate. An output shaft of the caster motor is connected with the caster rotating shaft through a coupling. The caster is fixedly installed below the caster connecting piece.

On the basis of the above solution, the shell component includes a shell, a front view glass, a side view glass and a rear door. The shell is fixedly installed around the outer side of the frame. The front view glass is fixedly installed in the front of the shell. The side view glass is fixedly installed on the outer side of the shell. The rear door is installed at the rear of the frame through hinges.

On the basis of the above solution, the electric control component includes an electric control screen, an electric control outer shell and an electric control box. The electric control outer shell is fixedly installed above the frame. The electric control screen is fixedly installed in the front of the electric control outer shell. The electric control box is fixedly installed in front of the inner side of the frame.

On the basis of the above solution, the electric control component also includes a battery box. The battery box is fixedly installed at the rear of the inner side of the frame, and a rechargeable lithium battery is installed in the battery box.

The present disclosure has the following beneficial effects.

Firstly, compared with traditional grinding equipment, the road-rail dual purpose quick disassembly and assembly type rail grinding maintenance robot in the present disclosure is in a split assembly mode of left and right units, so that the assembly and disassembly are simple and quick, and is convenient for equipment handling and transportation.

Secondly, compared with traditional grinding equipment, the road-rail dual purpose quick disassembly and assembly type rail grinding maintenance robot in the present disclosure can achieve rapid walking on roads and rails respectively through the road walking devices and the rail walking device, so that the efficiency is high during grinding operation, and the robot is more convenient to transport to other sites on roads.

Thirdly, compared with traditional grinding equipment, the robot grinding device in the road-rail dual purpose quick disassembly and assembly type rail grinding maintenance robot in the present disclosure achieves full profile grinding of the rail through the guide rail and the series and parallel mechanical arms so that the degree of intelligence and flexibility of the rail grinding device is significantly improved.

BRIEF DESCRIPTION OF THE DRAWINGS

The present disclosure has the following accompanying drawings.

REFERENCE SIGNS IN THE ACCOMPANYING DRAWINGS

1 side view glass; 2 shell; 3 front view glass; 4 electric control outer shell; 5 electric control screen; 6 quick unit connecting device; 7 electric control box; 8 rail front wheel; 9 rail front wheel dust board; 10 rail rear wheel dust board; 11 rail rear wheel; 12 rear door; 13 frame; 14 guide rail mechanism; 15 grinding mechanism; 16 battery box; 17 connecting device base; 18 road walking device; 19 base; 20 rotating flange bearing; 21 electromagnet; 22 unit connecting tightening nut; 23 electromagnet tightening bolt; 24 rotatable flange; 25 end face gasket; 26 unit connecting tightening bolt; 27 guide rail substrate; 28 support end bearing seat; 29 guide rail; 30 guide rail sliding block; 31 guide rail motor; 32 motor fixing plate; 33 fixed end bearing seat; 34 lead screw; 35 sliding block connecting plate; 36 grinding wheel motor; 37 mechanical arm motor; 38 secondary mechanical arm; 39 gear transmission shaft; 40 primary mechanical arm; 41 mechanical arm end cover; 42 main body base; 43 motor output gear; 44 gear outer end gasket; 45 transmission gear; 46 mechanical arm joint; 47 upper connecting flange; 48 flange support plate; 49 lower connecting flange; 50 grinding wheel connecting sleeve; 51 grinding wheel cover; 52 grinding wheel; 53 upper mounting base; 54 joint outer end cover; 55 joint rotating shaft; 56 lower mounting base; 57 caster; 58 caster connecting piece; 59 caster motor; 60 motor mounting plate; 61 caster rotating shaft; 62 caster fixing base; 63 caster support plate; 64 rail; and 65 caster support bolt.

DETAILED DESCRIPTION OF THE EMBODIMENTS

The present disclosure is further clarified with reference to FIG. 1 to FIG. 12 and specific embodiments. It should be understood that these embodiments are only used to illustrate the present disclosure and are not used to limit the scope of the present disclosure. After the present disclosure is read, various equivalent modifications of the present disclosure made by those skilled in the art all fall within the scope defined by the appended claims of this application.

Figure 1:
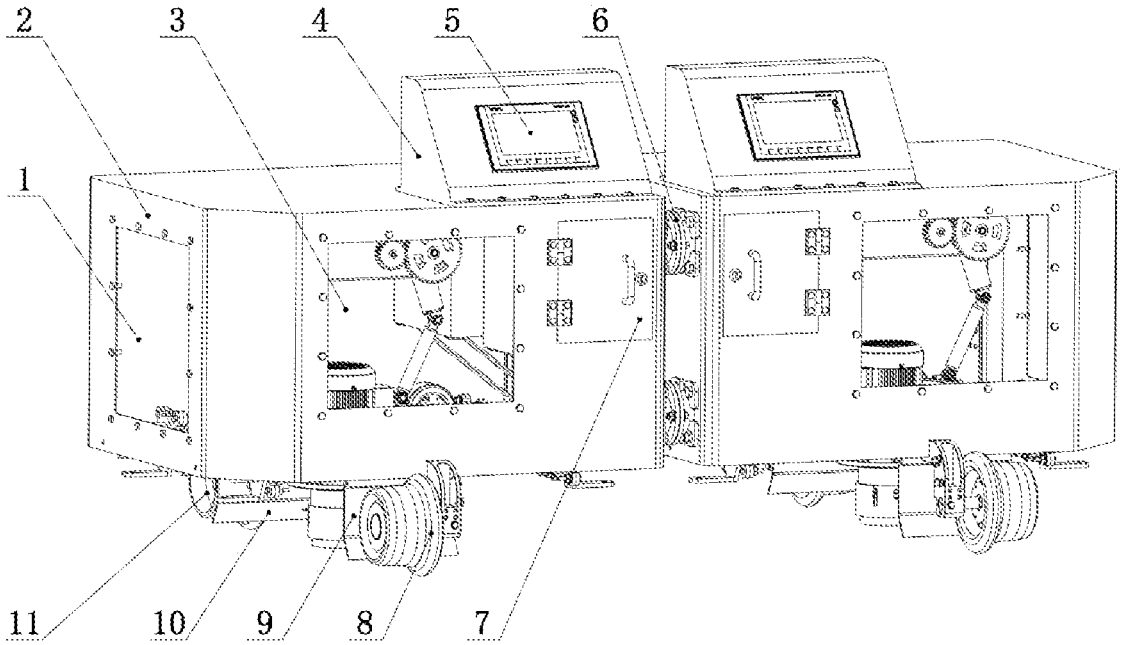
FIG. 1 is an integral schematic diagram of a road-rail dual purpose quick disassembly and assembly type rail grinding maintenance robot in an embodiment of the present disclosure.
Figure 2:
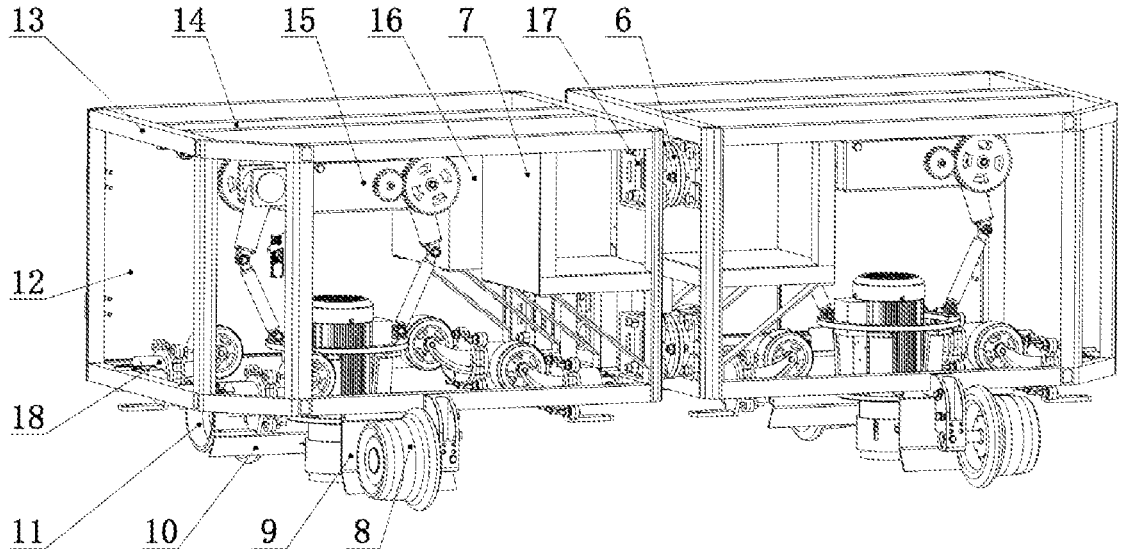
FIG. 2 is an internal structural schematic diagram of a road-rail dual purpose quick disassembly and assembly type rail grinding maintenance robot in an embodiment of the present disclosure.

Referring to FIG. 1 and FIG. 2, disclosed is a road-rail dual purpose quick disassembly and assembly type rail grinding maintenance robot. The road-rail dual purpose quick disassembly and assembly type rail grinding maintenance robot includes two robot grinding units and quick unit connecting devices 6. The two robot grinding units are fixedly connected to both sides through the quick unit connecting devices 6. The robot grinding unit includes a robot grinding device, a rail walking device, road walking devices 18, a frame 13, a shell component and an electric control component. The robot grinding device is fixedly installed on the inner side of the upper part of the frame. The rail walking device is fixedly installed at the bottom of the frame. The road walking devices 18 are fixedly installed at the bottom of the frame 13. The shell component is fixedly installed on the frame. The electric control component is fixedly installed on the frame 13. Each part of the entire robot is controlled by the electric control component, including the grinding position, grinding angle, grinding speed and so on. By means of the quick unit connecting devices 6, the two robot grinding units can be quickly assembled and disassembled during the working process, thus facilitating changes of the working and transportation states of the robot.

Figure 3:
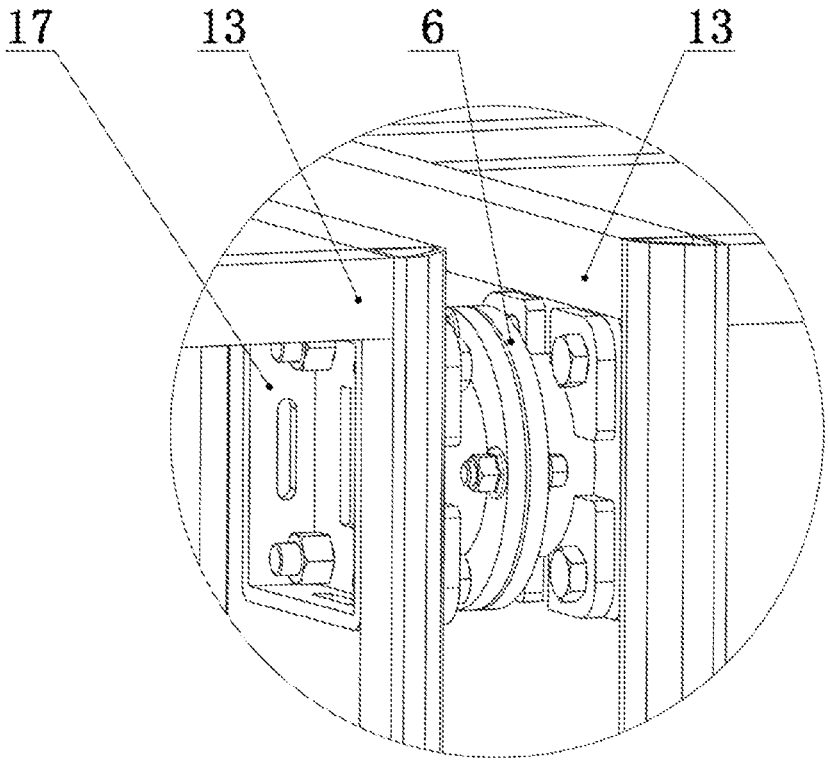
FIG. 3 is a local schematic diagram of the quick unit connecting devices in an embodiment of the present disclosure.
Figure 4:
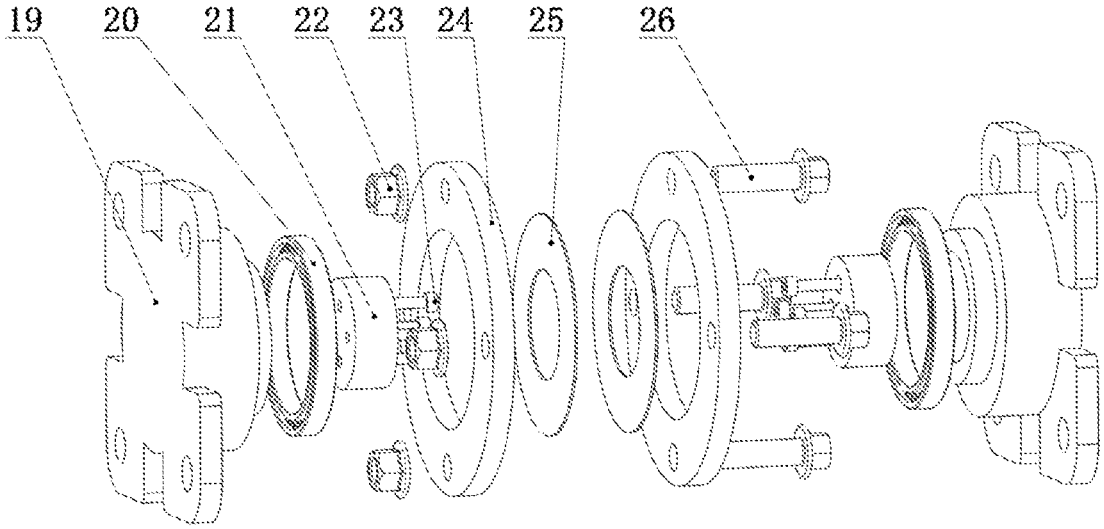
FIG. 4 is an exploded schematic diagram of the quick unit connecting devices in an embodiment of the present disclosure.

Referring to FIG. 2, FIG. 3 and FIG. 4, each of the quick unit connecting devices 6 includes a connecting device base 17, a base 19, a rotating flange bearing 20, an electromagnet 21, unit connecting tightening nuts 22, an electromagnet tightening bolt 23, a rotatable flange 24, an end face gasket 25 and unit connecting tightening bolts 26. Wherein, there are eight connecting device bases 17, and four connecting device bases 17 are arranged in each of the two robot grinding units and fixedly installed at four corners of the inner side of the frame 13 respectively. The base 19 is fixedly connected with the connecting device base 17 through bolts, and the rotating flange bearing 20 is installed on an outer ring of a protruding part of the base 19. The rotatable flange 24 is installed on an outer ring of the rotating flange bearing 20, and the rotatable flange 24 can rotate freely through the rotating flange bearing 20. The electromagnet 21 is fixedly installed on an inner ring of the protruding part of the base 19 through an electromagnet tightening bolt 23. The end face gasket 25 is fixedly installed at an end face position of the rotatable flange 24. The unit connecting tightening nuts 22 and the unit connecting tightening bolts 26 are used for fixedly connecting two rotatable flanges 24. By changing the energized state of the electromagnet 21, the two robot grinding units can be quickly connected and positioned. When the electromagnet 21 is in the energized state, two opposite electromagnets 21 are firmly attracted, and under the action of rigid connection of the unit connecting tightening nuts 22 and the unit connecting tightening bolts 26, the two robot grinding units form a stable connection form, thus significantly improving the stability and stiffness during grinding.

Referring to FIG. 2, the robot grinding device includes a guide rail mechanism 14 and a grinding mechanism 15. The grinding mechanism 15 is installed below the guide rail mechanism 14. By means of the guide rail mechanism 14 and the grinding mechanism 15 installed below the guide rail mechanism 14, the full profile grinding of the rail can be achieved, so that the degree of intelligence and flexibility of the robot grinding device is significantly improved compared with the traditional equipment.

Figure 5:
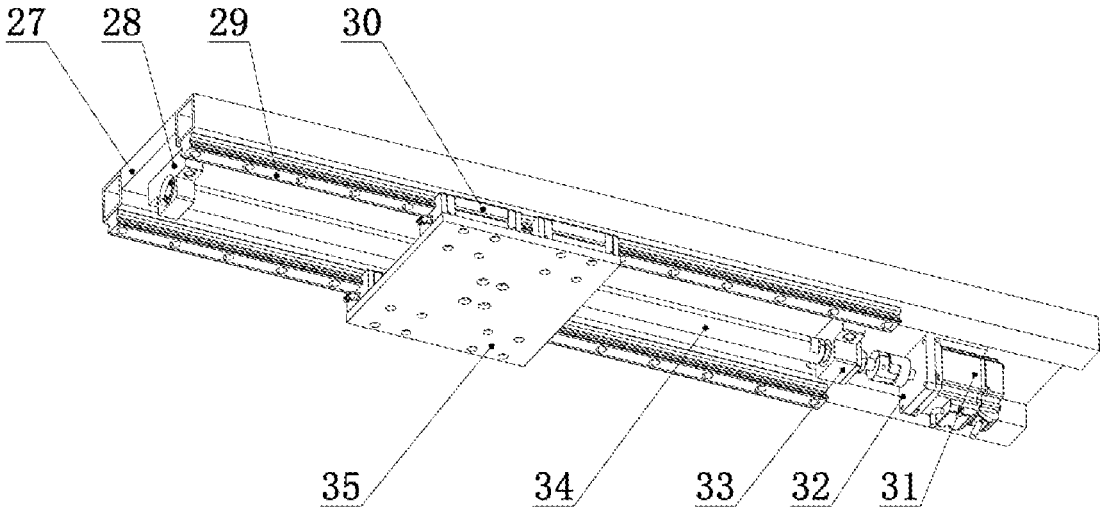
FIG. 5 is a structural schematic diagram of a guide rail mechanism in an embodiment of the present disclosure.

Referring to FIG. 2 and FIG. 5, the guide rail mechanism 14 includes a guide rail substrate 27, a support end bearing seat 28, a guide rail 29, a guide rail sliding block 30, a guide rail motor 31, a motor fixing plate 32, a fixed end bearing seat 33, a lead screw 34 and a sliding block connecting plate 35. Wherein, the guide rail substrate 27 is fixedly installed on the frame 13. Two guide rails 29 are fixedly installed below both sides of the guide rail substrate 27 through bolts. The support end bearing seat 28 is fixedly installed below one end of the guide rail substrate 27 through bolts, and the fixed end bearing seat 33 is fixedly installed below the other end of the guide rail substrate 27 through bolts. One end of the lead screw 34 is installed in the support end bearing seat 28, and the other end of the lead screw 34 is installed in the fixed end bearing seat 33. The four guide rail sliding blocks 30 are respectively installed on the two guide rails 29. The sliding block connecting plate 35 is fixedly installed below the four guide rail sliding blocks 30. The motor fixing plate 32 is fixedly installed below one end of the guide rail substrate 27 through bolts. The guide rail motor 31 is fixedly installed on the motor fixing plate 32 through bolts. The output shaft 31 of the guide rail motor is connected with one end of the lead screw 34 through a coupling. By controlling the guide rail motor 31, power can be transmitted to the lead screw 34 through the coupling, and the lead screw 34 rotates to drive the four guide rail sliding blocks 30 to move in the horizontal direction. Therefore, the siding block connecting plate 35 moves in the horizontal direction as well, so that the grinding mechanism 15 has a degree of freedom of movement in the horizontal direction.

Figure 6:
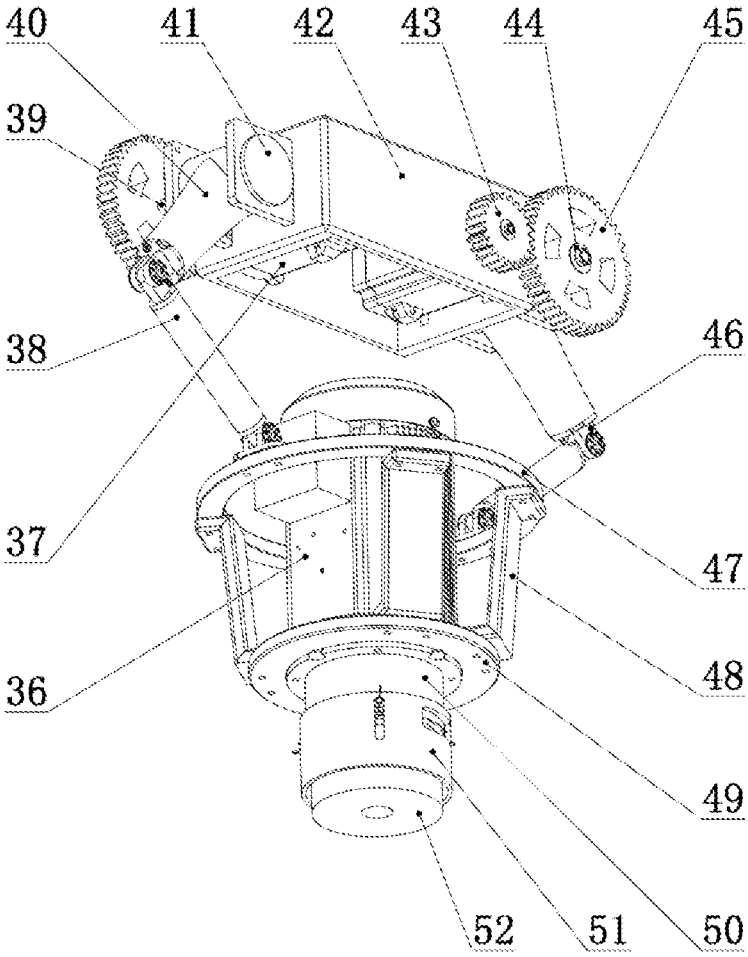
FIG. 6 is a structural schematic diagram of a grinding mechanism in an embodiment of the present disclosure.

Referring to FIG. 2, FIG. 5 and FIG. 6, the grinding mechanism 15 includes a grinding wheel motor 36, a mechanical arm motor 37, a secondary mechanical arm 38, a gear transmission shaft 39, a primary mechanical arm 40, a mechanical arm end cover 41, a main body base 42, a motor output gear 43, a gear outer end gasket 44, a transmission gear 45, a mechanical arm joint 46, an upper connecting flange 47, a flange support plate 48, a lower connecting flange 49, a grinding wheel connecting sleeve 50, a grinding wheel cover 51 and a grinding wheel 52. Wherein, the main body base 42 is fixedly installed below the sliding block connecting plate 35. The two mechanical arm motors 37 are symmetrically and fixedly installed inside the main body base 42. An inner hole of the motor output gear 43 is matched and connected with an output shaft of the mechanical arm motor 37 through a shaft hole. The primary mechanical arm 40 is installed on connecting plates protruding on both sides of the main body base 42. The mechanical arm end cover 41 is fixedly installed on an outer end face of a cylindrical part of the primary mechanical arm 40. One end of the gear transmission shaft 39 is installed in the cylindrical part of the primary mechanical arm 40, and the other end of the gear transmission shaft 39 is matched and connected with the transmission gear 45 through a shaft hole. The transmission gear 45 is meshed and connected with the motor output gear 43. One end of the mechanical arm joint 46 is installed on a lower end face of the primary mechanical arm 40, and the other end of the mechanical arm joint 46 is installed on an upper end face of the secondary mechanical arm 38. The primary mechanical arm 40 is hinged and matched with the secondary mechanical arm 38 through the mechanical arm joint 46. The upper connecting flange 47 is hinged with the secondary mechanical arm 38 through the mechanical arm joint 46. There are four flange support plates 48. An upper end of the flange support plate 48 is fixedly connected with the upper connecting flange 47 through bolts, and a lower end of the flange support plate 48 is fixedly connected with the lower connecting flange through bolts. The grinding wheel connecting sleeve 50 is fixedly installed below the lower connecting flange 49. The grinding wheel motor 36 is installed above the grinding wheel connecting sleeve 50. The grinding wheel 52 is installed below the grinding wheel connecting sleeve 50, and an inner hole of the grinding wheel 52 is matched and connected with an output shaft of the grinding wheel motor 36 through a shaft hole. The grinding wheel cover 51 is fixedly installed on the periphery of the grinding wheel connecting sleeve 50 through butterfly bolts. By controlling the mechanical arm motor 37, power is transmitted to the motor output gear 43 through the gear transmission shaft 39, and then the power is transmitted to the transmission gear 45 through gear meshing, so that the primary mechanical arm 40 is driven to move. The primary mechanical arm 40 drives the secondary mechanical arm 38 to move through the mechanical arm joint 46, and then the upper connecting flange 47 hinged and matched with the secondary mechanical arm 38 is driven to move, so that the grinding wheel 52 at the bottom of the grinding mechanism moves to complete full profile grinding of the rail.

Figure 7:
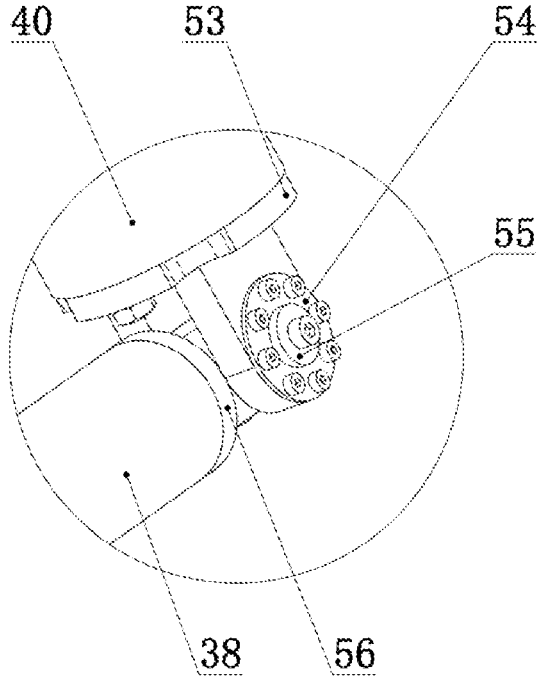
FIG. 7 is a local schematic diagram of a mechanical arm joint in an embodiment of the present disclosure.

Referring to FIG. 6 and FIG. 7, the mechanical arm joint 46 includes an upper mounting base 53, a joint outer end cover 54, a joint rotating shaft 55 and a lower mounting base 56. Wherein, the upper mounting base 53 is fixedly installed on the lower end face of the primary mechanical arm 40 through bolts. The lower mounting base 56 is fixedly installed on the upper end face of the secondary mechanical arm 38 through bolts. The joint rotating shaft 55 is installed in inner holes of the upper mounting base 53 and the lower mounting base 56 through bearings. The upper mounting base 53 is hinged with the lower mounting base 56. The joint outer end cover 54 is fixedly installed on the outer end face of the upper mounting base 53 through bolts.

Referring to FIG. 2, the rail walking device includes a rail front wheel 8, a rail front wheel dust board 9, a rail rear wheel dust board 10 and a rail rear wheel 11. Wherein, the rail front wheel 8 is fixedly installed in the front of the bottom of the frame 13 through bolts. The rail front wheel dust board 9 is fixedly installed on the inner side of the rail front wheel 8 through bolts. The rail rear wheel 11 is fixedly installed at the rear of the bottom of the frame 13 through bolts. The rail rear wheel dust board 10 is fixedly installed on the inner side of the rail rear wheel through bolts. By means of the rail walking device, the robot has the function of rapid moving on rails.

Figure 8:
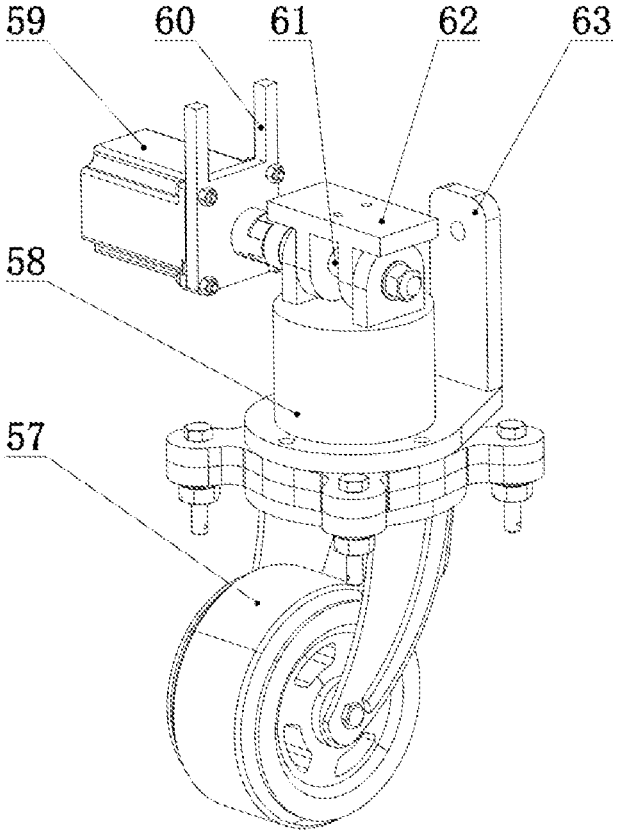
FIG. 8 is a structural schematic diagram of each road walking device in an embodiment of the present disclosure.

Referring to FIG. 2 and FIG. 8, each of the road walking devices 18 includes a caster 57, a caster connecting piece 58, a caster motor 59, a motor mounting plate 60, a caster rotating shaft 61, a caster fixing base 62 and a caster support plate 63. Wherein, the motor mounting plate 60 is fixedly connected with the frame 13. The caster fixing base 62 is fixedly connected with the frame 13 through bolts. An inner hole in an upper end of the caster connecting piece 58 is connected with the caster fixing base 62 through the caster rotating shaft 61. The caster motor 59 is fixedly connected with the motor mounting plate 60 through bolts. An output shaft of the caster motor 59 is connected with the caster rotating shaft 61 through a coupling. The caster 57 is fixedly installed below the caster connecting piece 58. By means of the road walking devices, the robot has the function of rapid moving on roads.

Referring to FIG. 1, the shell component includes front view glass 1, a shell 2, side view glass 3 and a rear door 12. Wherein, the shell 2 is fixedly installed around the outer side of the frame 13. The front view glass 3 is fixedly installed in the front of the shell 2 through bolts, and the side view glass 1 is fixedly installed on the outer side of the shell 2 through bolts. Working conditions inside the robot can be observed instantly through the front view glass 3 and the side view glass 1, so that corresponding dynamic adjustment is carried out. The rear door 12 is installed at the rear of the frame 13 through hinges. The rear door 12 is of a double-door structure, so that internal parts can be adjusted and replaced immediately through the rear door 12.

Referring to FIG. 1 and FIG. 2, the electric control component includes an electric control outer shell 4, an electric control screen 5, an electric control box 7 and a battery box 16. Wherein, the electric control outer shell 4 is fixedly installed above the frame 13. The electric control screen 5 is fixedly installed in the front of the electric control outer shell 4, and an electric system of the robot grinding unit can be controlled conveniently and rapidly through the electric control screen 5. The electric control box 7 is fixedly installed in front of the inner side of the frame 13, and assemblies of the electric control system are placed in the electric control box 7. The battery box 16 is fixedly installed at the rear of the inner side of the frame 13, and a rechargeable lithium battery is installed in the battery box 16 for supplying power to the electric system in the unit, which is not only efficient but also has good environmental benefits.

Figure 9:
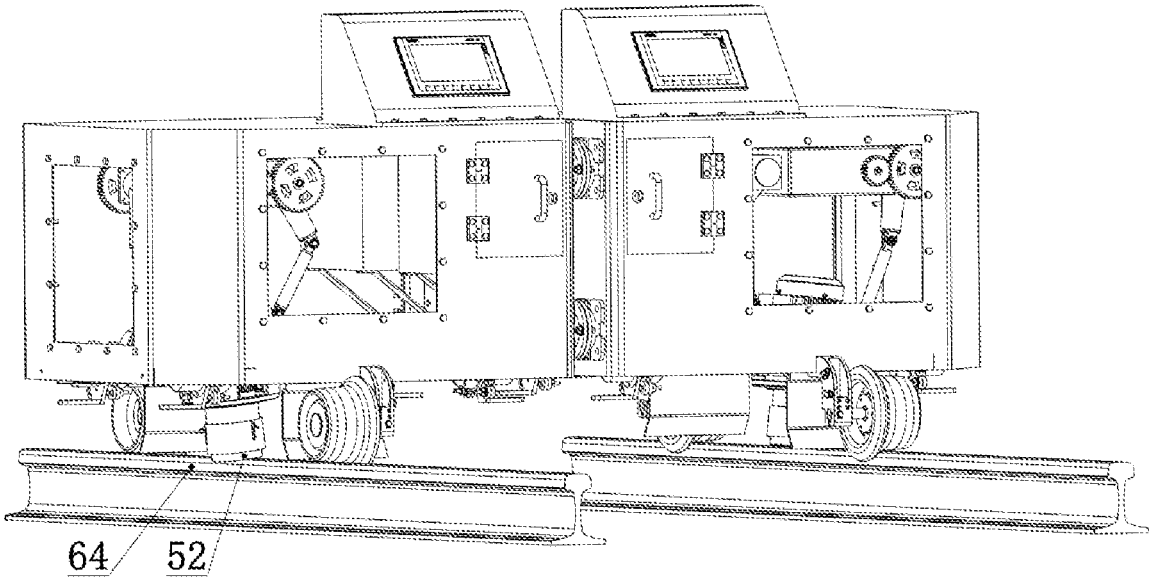
FIG. 9 is a schematic diagram of the use of a road-rail dual purpose quick disassembly and assembly type rail grinding maintenance robot in an embodiment of the present disclosure.
Figure 10:
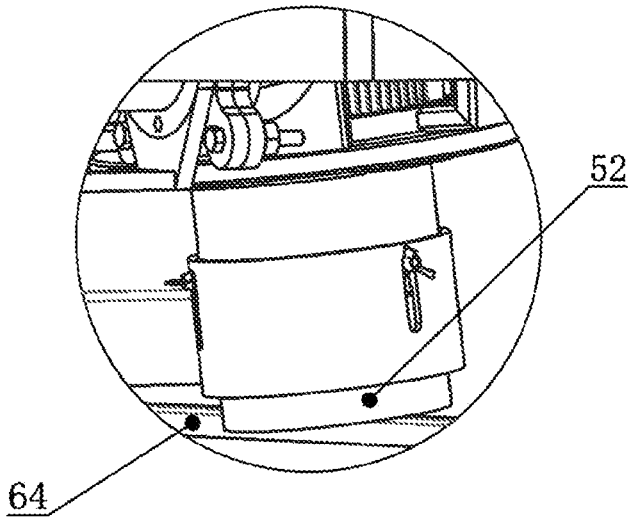
FIG. 10 is a local schematic diagram of a rail ground by a grinding wheel in an embodiment of the present disclosure.

Referring to FIG. 9 and FIG. 10, disclosed is an actual rail grinding process of a road-rail dual purpose quick disassembly and assembly type rail grinding maintenance robot. The electric control screen 5 controls the guide rail mechanism 14 and the grinding mechanism 15 to cooperate with each other, so that the grinding wheel 52 at the bottom of the grinding mechanism 15 is accurately moved to a position to be ground on the rail 64, and then the grinding wheel 52 is rotated by controlling power output of the grinding wheel motor 36 to grind the rail 64. The whole process is in a digital control mode, so that the accuracy and efficiency of the rail grinding process can be significantly improved.

Figure 11:
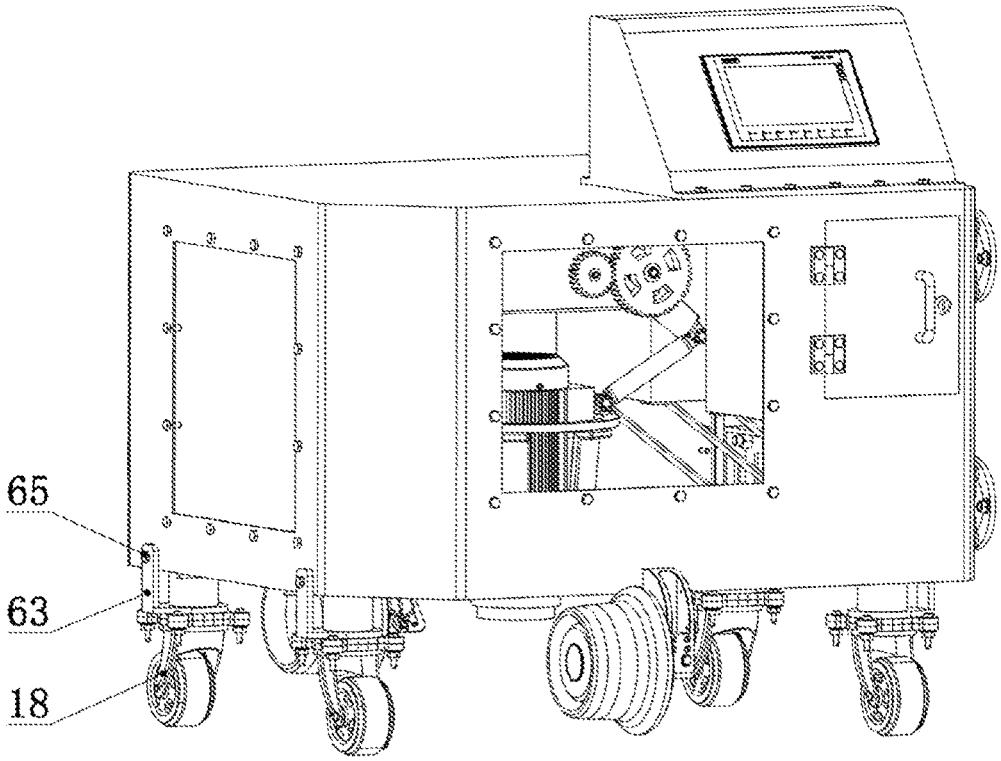
FIG. 11 is a schematic diagram of the road movement state of a left robot grinding unit of a road-rail dual purpose quick disassembly and assembly type rail grinding maintenance robot in an embodiment of the present disclosure.
Figure 12:
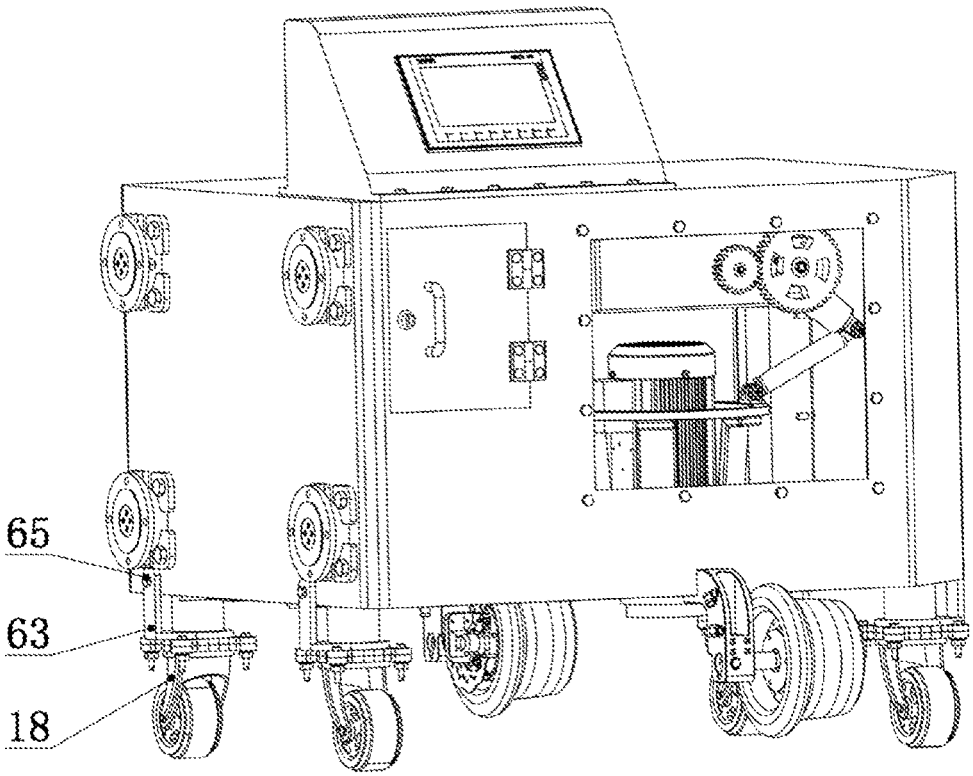
FIG. 12 is a schematic diagram of the road movement state of a right robot grinding unit of a road-rail dual purpose quick disassembly and assembly type rail grinding maintenance robot in an embodiment of the present disclosure.

Referring to FIG. 11 and FIG. 12, disclosed is a ground movement state of the two robot grinding units in the road-rail dual purpose quick disassembly and assembly type rail grinding maintenance robot. The electric control screen 5 controls power output of the caster motor 59 to rotate the caster 57 to a position where a pin hole in the caster support plate 63 corresponds to a hole in the outer side of the shell, and then a caster support bolt 65 is inserted into the two holes, so that the road walking devices 18 are fixed at the position. At that time, the unit is in a movable state on a flat ground, so that the maneuverability of the robot is improved.

What has not been described in detail in this specification belongs to the prior art which is well known to those skilled in the art.

What is claimed is:

1. A road-rail dual purpose quick disassembly and assembly rail grinding maintenance robot, wherein the road-rail dual purpose quick disassembly and assembly rail grinding maintenance robot comprises a left robot grinding unit used for grinding a left rail; a right robot grinding unit used for grinding a right rail; quick unit connecting devices used for connecting the left robot grinding unit and the right robot grinding unit;

each of the left robot grinding unit and the right robot grinding unit comprises a robot grinding device, a rail walking device, road walking devices, a frame, a shell component and an electric control component;

the robot grinding device is fixedly installed on an inner side of an upper part of the frame;

during working, a front end of the robot grinding device extends out from an inner side of the frame to a position of a rail, and full profile grinding of the rail is achieved by adjusting position and posture of the robot grinding device;

the rail walking device is fixedly installed at a bottom of the frame;

the road walking device is fixedly installed at the bottom of the frame;

the shell component is fixedly installed on the frame and used for covering and protecting components inside the frame; and the electric control component is fixedly installed on the frame and used for controlling the grinding position, grinding angle and grinding speed;

wherein each of the quick unit connecting devices comprises a connecting device base, a base, a rotating flange bearing, an electromagnet, unit connecting tightening nuts, an electromagnet tightening bolt, a rotatable flange, an end face gasket and unit connecting tightening bolts;

the connecting device base is fixedly installed below the frame;

the base is fixedly connected with the connecting device base through bolts, and the rotating flange bearing is installed on an outer ring of a protruding part of the base;

the rotatable flange is installed on an outer ring of the rotating flange bearing;

the electromagnet is fixedly installed on an inner ring of the protruding part of the base through the electromagnet tightening bolt; the end face gasket is fixedly installed at a position of an end face of the rotatable flange; and the unit connecting tightening nuts and the unit connecting tightening bolts are used for fixedly connecting two rotatable flanges.

2. The road-rail dual purpose quick disassembly and assembly rail grinding maintenance robot according to claim 1, wherein the robot grinding device comprises a guide rail mechanism and a grinding mechanism;

the grinding mechanism is installed below the guide rail mechanism;

the grinding mechanism comprises a grinding wheel motor, a mechanical arm motor, a secondary mechanical arm, a gear transmission shaft, a primary mechanical arm, a mechanical arm end cover, a main body base, a motor output gear, a gear outer end gasket, a transmission gear, a mechanical arm joint, an upper connecting flange, a flange support plate, a lower connecting flange, a grinding wheel connecting sleeve, a grinding wheel cover and a grinding wheel;

the guide rail mechanism is fixedly installed on the inner side of the upper part of the frame;

the main body base is fixedly installed below the guide rail mechanism;

the mechanical arm motor is fixedly installed inside the main body base;

an inner hole of the motor output gear is matched and connected with an output shaft of the mechanical arm motor through a shaft hole;

the primary mechanical arm is installed on connecting plates protruding on both sides of the main body base;

the mechanical arm end cover is fixedly installed on an outer end face of a cylindrical part of the primary mechanical arm;

one end of the gear transmission shaft is installed in the cylindrical part of the primary mechanical arm, and another end of the gear transmission shaft is matched and connected with the transmission gear through the shaft hole;

the transmission gear is meshed and connected with the motor output gear;

one end of the mechanical arm joint is installed on a lower end face of the primary mechanical arm, another end of the mechanical arm joint is installed on an upper end face of the secondary mechanical arm, and the primary mechanical arm is hinged and matched with the secondary mechanical arm;

the upper connecting flange is hinged with the secondary mechanical arm through the mechanical arm joint;

an upper end of the flange support plate is fixedly connected with the upper connecting flange, and a lower end of the flange support plate is fixedly connected with the lower connecting flange;

the grinding wheel connecting sleeve is fixedly installed below the lower connecting flange;

the grinding wheel motor is installed above the grinding wheel connecting sleeve;

the grinding wheel is installed below the grinding wheel connecting sleeve, and an inner hole of the grinding wheel is matched and connected with an output shaft of the grinding wheel motor through the shaft hole; and the grinding wheel cover is fixedly installed on a periphery of the grinding wheel connecting sleeve.

3. The road-rail dual purpose quick disassembly and assembly rail grinding maintenance robot according to claim 2, wherein the mechanical arm joint comprises an upper mounting base, a joint outer end cover, a joint rotating shaft and a lower mounting base;

the upper mounting base is fixedly installed on the lower end face of the primary mechanical arm;

the lower mounting base is fixedly installed on the upper end face of the secondary mechanical arm;

the joint rotating shaft is installed in inner holes of the upper mounting base and the lower mounting base through bearings;

the upper mounting base is hinged with the lower mounting base; and the joint outer end cover is fixedly installed on an outer end face of the upper mounting base.

4. The road-rail dual purpose quick disassembly and assembly rail grinding maintenance robot according to claim 1, wherein the rail walking device comprises a rail front wheel and a rail rear wheel;

the rail front wheel is fixedly installed in a front of the bottom of the frame; and the rail rear wheel is fixedly installed at a rear of the bottom of the frame.

5. The road-rail dual purpose quick disassembly and assembly rail grinding maintenance robot according to claim 4, further comprising a rail front wheel dust board and a rail rear wheel dust board, wherein the rail front wheel dust board is fixedly installed on an inner side of the rail front wheel; and the rail rear wheel dust board is fixedly installed on an inner side of the rail rear wheel.

6. The road-rail dual purpose quick disassembly and assembly rail grinding maintenance robot according to claim 1, wherein each of the road walking devices comprises a caster, a caster connecting piece, a caster motor, a motor mounting plate, a caster rotating shaft, a caster fixing base and a caster support plate;

the motor mounting plate is fixedly connected with the frame;

the caster fixing base is fixedly connected with the frame;

an inner hole at an upper end of the caster connecting piece is connected with the caster fixing base through the caster rotating shaft;

the caster motor is fixedly connected with the motor mounting plate;

an output shaft of the caster motor is connected with the caster rotating shaft through a coupling; and the caster is fixedly installed below the caster connecting piece.

7. The road-rail dual purpose quick disassembly and assembly rail grinding maintenance robot according to claim 1, wherein the shell component comprises a shell, a front view glass, a side view glass and a rear door;

the shell is fixedly installed around an outer side of the frame;

the front view glass is fixedly installed in a front of the shell;

the side view glass is fixedly installed on an outer side of the shell; and the rear door is installed at a rear of the frame through hinges.

8. The road-rail dual purpose quick disassembly and assembly rail grinding maintenance robot according to claim 1, wherein the electric control component comprises an electric control screen, an electric control outer shell and an electric control box;

the electric control outer shell is fixedly installed above the frame;

the electric control screen is fixedly installed in a front of the electric control outer shell; and the electric control box is fixedly installed in a front of the inner side of the frame.

9. The road-rail dual purpose quick disassembly and assembly rail grinding maintenance robot according to claim 8, also comprising a battery box, wherein the battery box is fixedly installed at a rear of the inner side of the frame, and a rechargeable lithium battery is installed in the battery box.

* * * * *